US007249910B2

(12) United States Patent
Eckert et al.

(10) Patent No.: US 7,249,910 B2
(45) Date of Patent: Jul. 31, 2007

(54) REMOVABLE DELINEATOR POST AND METHOD FOR THE USE THEREOF

(75) Inventors: Bret R. Eckert, Rocklin, CA (US); Jeffrey M. Thompson, Roseville, CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 27 days.

(21) Appl. No.: 10/841,972

(22) Filed: May 6, 2004

(65) Prior Publication Data

US 2005/0249553 A1 Nov. 10, 2005

(51) Int. Cl.
*E01F 9/00* (2006.01)
*E01F 9/011* (2006.01)
*E01F 9/012* (2006.01)
*E01F 9/013* (2006.01)

(52) U.S. Cl. ..... 404/10; 404/9; 248/158

(58) Field of Classification Search ..... 404/6, 404/9–11; 256/13.1; 49/49; 248/158
See application file for complete search history.

(56) References Cited

U.S. PATENT DOCUMENTS 243,696 A * 7/1881 Faloon ..... 256/35
1,726,817 A * 9/1929 Franklin ..... 40/608
2,949,324 A 8/1960 Birge et al.
3,111,303 A * 11/1963 Olson ..... 256/19
3,279,133 A * 10/1966 De Korte ..... 52/103
3,335,534 A 8/1967 Hester et al.
3,371,647 A * 3/1968 Shopbell ..... 116/209
3,421,473 A * 1/1969 Weichenrieder ..... 116/63 R
3,969,853 A * 7/1976 Deike ..... 52/156

(Continued)

FOREIGN PATENT DOCUMENTS

FR 2 671 837 A1 7/1992

(Continued)

OTHER PUBLICATIONS

"KonaPost™ Delineator: Quick, Extremely Durable Warning!," two pages, date unknown.

(Continued)

*Primary Examiner*—Raymond W Addie
(74) *Attorney, Agent, or Firm*—Brinks Hofer Gilson & Lione

(57) ABSTRACT

A delineator includes a post having a bottom portion and a stem extending from the bottom portion. At least a portion of the post is moveable in a lateral direction between an at-rest position and an impact position. An anchor includes a top and an elongated receptacle. In one aspect, the stem is removably inserted in the receptacle and is moveable in a longitudinal direction between at least a first position and a second position relative to the receptacle as the flexible post is moved between the at-rest position and the impact position respectively. A first portion of the length of the stem is disposed in the receptacle when the stem is in the first position and a second portion of the length of the stem remains disposed in the receptacle when the stem is in the second position, wherein the first portion is greater than the second portion. Methods of removably retaining a boundary in a pathway and of installing a boundary in a pathway are also provided.

20 Claims, 2 Drawing Sheets

U.S. PATENT DOCUMENTS 4,161,723 A * 7/1979 De Vittori ..... 340/323 R
4,240,766 A 12/1980 Smith et al.
4,343,567 A 8/1982 Sarver et al.
4,522,530 A 6/1985 Arthur
4,599,012 A 7/1986 Kugler et al.
4,636,108 A 1/1987 Duckett
5,090,348 A 2/1992 Hugron
5,186,119 A 2/1993 Hlavin
5,197,819 A 3/1993 Hughes
5,207,175 A 5/1993 Andonian
5,518,337 A 5/1996 Modlin
5,625,988 A * 5/1997 Killick ..... 52/298
5,895,169 A 4/1999 Holm et al.
6,560,935 B1 5/2003 Barefield et al.
6,821,050 B1 * 11/2004 Maldonado ..... 404/6

FOREIGN PATENT DOCUMENTS

GB 2 058 890 A 4/1981
WO WO 00/75432 A1 12/2000

OTHER PUBLICATIONS

"Safe-Hit®: KonaPost™ Installation Instructions, For Installation in Asphalt or Concrete," Document #119800DPIS, one page, date unknown.
The Line Connection, Inc.: The DURA-POST®4 illustration, date unknown.
International Search Report, mailing date of Nov. 8, 2005, 9 pages for PCT/US05/12809.

* cited by examiner

REMOVABLE DELINEATOR POST AND METHOD FOR THE USE THEREOF

BACKGROUND

The present invention relates to a removable delineator post and method for the use thereof, and in particular, to a delineator post that is easily installed and removed without any retention mechanism but is self-retaining upon impact from an errant vehicle or other object.

Delineators are commonly used to create boundaries and mark lanes for defined flow of traffic, including without limitation vehicular and pedestrian traffic. For example, delineators can be used for gate closures, reversible lanes, lane redirection, parking lots and garages and event management. It may be desirable for the delineators to remain or return to an erect or upright position when impacted, for example by an errant vehicle, such that they retain their marking function. This may be particularly applicable when the delineators are not being monitored. To solve this problem, many delineators are fixedly attached to an anchor and/or the ground, such that they are difficult to install and cannot be easily removed after use.

SUMMARY

Briefly stated, in one preferred embodiment described below, a delineator includes a post having a bottom portion and a stem extending from the bottom portion. The stem has an outer diameter and a length. At least a portion of the post is moveable in a lateral direction between an at-rest position and an impact position. An anchor includes a top and an elongated receptacle having an inner diameter. The inner diameter of the receptacle is greater than the outer diameter of the stem and the outer diameter of the stem is at least about 95% of the inner diameter of the receptacle. The stem is removably inserted in the receptacle and is moveable in a longitudinal direction between at least a first position and a second position relative to the receptacle as the post is moved between the at-rest position and the impact position respectively. A first portion of the length of the stem is disposed in the receptacle when the stem is in the first position and a second portion of the length of the stem remains disposed in the receptacle when the stem is in the second position, wherein the first portion is greater than the second portion.

In another aspect, the delineator includes a post having a bottom portion and a stem extending longitudinally from the bottom portion. An anchor includes a top and an elongated, longitudinally extending receptacle. The stem is removably inserted in the receptacle. At least a portion of the flexible post is moveable in a lateral direction between an at-rest position and an impact position in response to an impact from a vehicle traveling at 45 mph. The stem is moveable in a longitudinal direction between at least a first position and a second position relative to the receptacle as the flexible post is moved between the at-rest position and the impact position respectively. A first portion of the length of the stem is disposed in the receptacle when the stem is in the first position and a second portion of the length of the stem remains disposed in the receptacle when the stem is in the second position. The first portion is greater than the second portion.

In yet another aspect, a delineator includes a post having a bottom portion and a stem extending longitudinally from the bottom portion. An anchor includes a top and an elongated, longitudinally extending receptacle. The stem is removably inserted in the receptacle, with the stem being freely moveable relative to the receptacle in the longitudinal direction free of any retention mechanism. At least a portion of the post is moveable in a lateral direction between an at-rest position and an impact position in response to an impact from a vehicle traveling at least 30 mph. At least a portion of the stem is retained in the receptacle as the post is moved between the at-rest position and the impact position.

In another aspect, a method of removably retaining a boundary in a pathway includes providing a delineator having a flexible post, which includes a bottom portion and a stem extending from the bottom portion. The method further includes installing an anchor into the pathway, wherein the anchor includes a top and an elongated receptacle. The method further includes installing the delineator on the pathway by inserting the stem into the receptacle, wherein the post extends upwardly from the anchor above the pathway. The method also includes impacting the post above the anchor with a vehicle traveling at 45 mph and thereby partially removing the stem from the receptacle while retaining at least a portion of the stem within the receptacle, and allowing the stem to self-insert and settle into the cavity without human intervention after the impact. In another aspect, the delineator is freely moveable relative to the anchor free of any retention mechanism and can be easily removed from the anchor simply by lifting the delineator.

In another aspect, the method includes providing a stem freely moveable relative to a receptacle in a longitudinal direction free of any retention mechanism. The method further includes impacting a post above an anchor with a vehicle traveling at least 30 mph, and retaining at least a portion of the stem within the receptacle.

In yet another aspect, a method of installing a boundary in a pathway includes providing a delineator having a flexible post, which includes a bottom portion and a stem extending from the bottom portion. The stem has an outer diameter. The method further includes installing an anchor into the pathway, wherein the anchor includes a top and an elongated receptacle having an inner diameter. The inner diameter is greater than the outer diameter and the outer diameter is at least about 95% of the inner diameter. The method further includes installing the delineator on the pathway by inserting the stem into the receptacle, wherein the post extends upwardly from the anchor above the pathway.

The delineator and method of installation provide significant advantages over other delineators. For example, the delineator can be easily installed simply by inserting the stem into the receptacle, without any tools or engagement of a retention mechanism. Conversely, the delineator can be easily removed simply by lifting the post without the need to disengage, remove or otherwise bypass a retention mechanism. At the same time, the unique relationship and configuration of the stem and anchor receptacle retains the post and maintains the deployment thereof even when impacted by a passing object, such as a vehicle. Accordingly, the delineators will remain deployed and function as markers without monitoring and supervision by the user.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
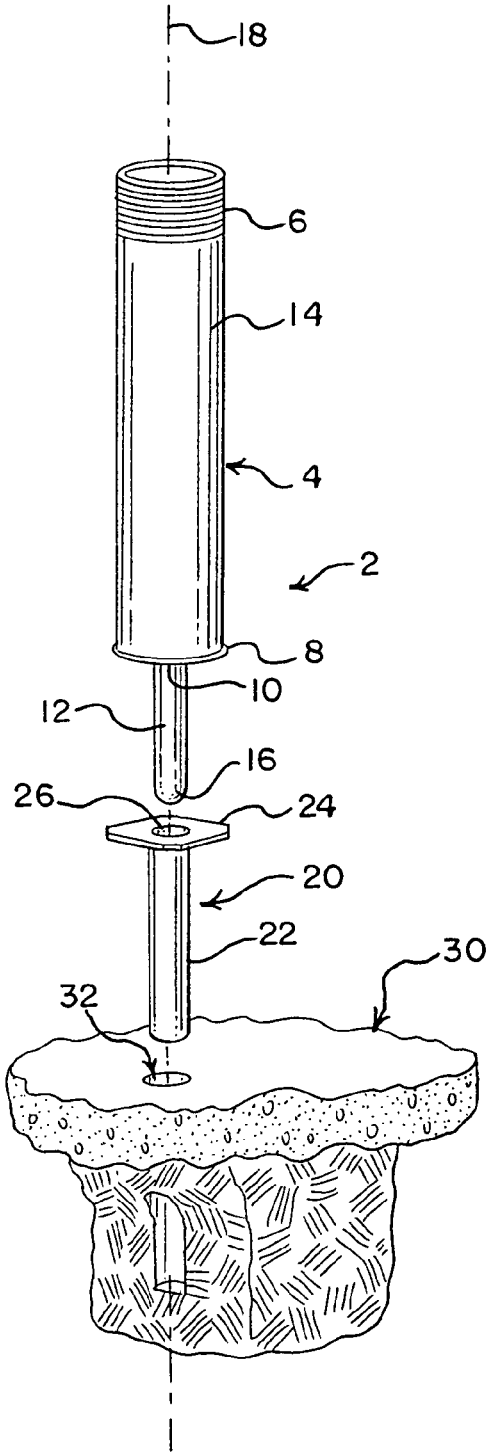
FIG. 1 is an exploded perspective view of a delineator assembly and pathway.
Figure 2:
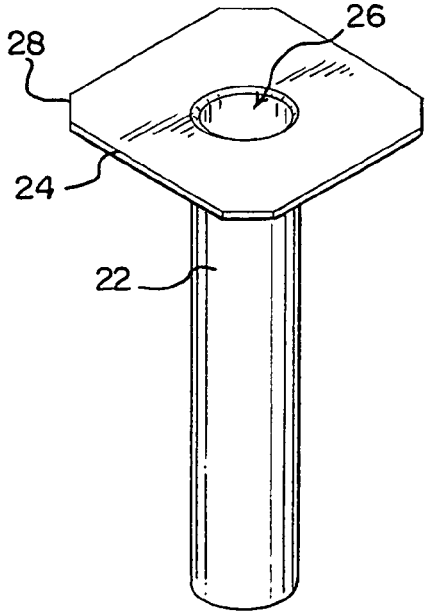
FIG. 2 is a perspective view of an anchor.
Figure 3:
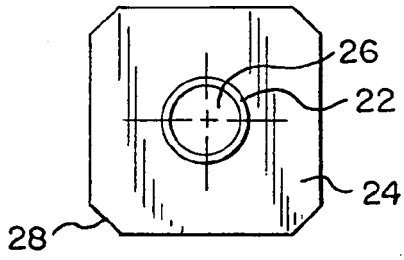
FIG. 3 is a top view of the anchor shown in FIG. 2.
Figure 4:
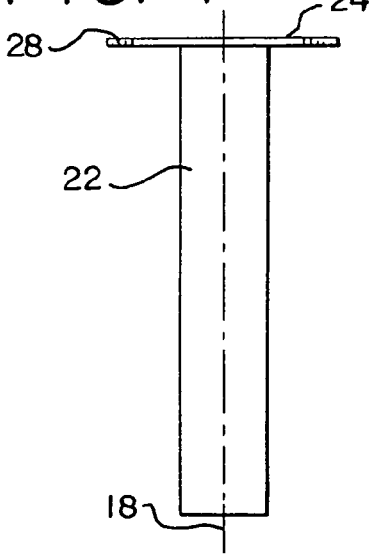
FIG. 4 is a side view of the anchor shown in FIG. 2.

Referring to FIGS. 1–4, a delineator 2 includes a post 4 having a top 6 and a bottom portion 8. The bottom portion 8 includes a bottom wall 10. A stem 12 extends in a longitudinal direction from the bottom wall along a longitudinal axis 18. The term "longitudinal" refers to the length or lengthwise direction. The term "lateral" refers a side or side-to-side direction, generally substantially perpendicular to the longitudinal direction.

The delineator 2 is preferably made by injection molding a polyurethane plastic, although it should be understood that it can be made of any type of flexible material, including for example and without limitation various plastics, elastomeric materials, etc., or of a relatively non-flexible material, including for example and without limitation metal, wood or rigid plastics. In one preferred embodiment, the post is made of a flexible material, allowing at least a portion of the post to bend, deflect or flex when impacted. In other embodiments, for example and without limitation where the post is made of a relatively non-flexible material, the post is provided with a hinge mechanism (or flexible portion) allowing the post to move in a lateral direction when impacted by a vehicle. The post may include a spring element that returns the post to an upright position. The hinge can be formed for example and without limitation as a living hinge or as a mechanical hinge. In other embodiments, the post is made of a flexible material and includes a hinge portion to provide additional flexibility.

In one embodiment, the post 4 is generally hollow and includes a circumferential wall 14, which has a thickness that increases from the top to the bottom of the post. The post 4 and stem 12 can be integrally formed, or made of separate components that are thereafter joined, for example by bonding or mechanical fasteners. The delineator, and in particular the post, can be made of various colors, including without limitation white, yellow and orange.

Various aspects of various embodiments of the delineator are disclosed in U.S. Pat. No. 5,518,337, entitled "Flexible Traffic Delineator and Mounting System," which is hereby incorporated herein by reference. One suitable delineator is the KonaPost™ delineator available from Safe-Hit® company, a division of Energy Absorption Systems, Inc., the assignee of U.S. Pat. No. 5,518,337 and the present application.

In one preferred embodiment, the post 4 has a width of about four (4) inches (10.16 cm) and a height of about 19 inches (48.26 cm). The stem 12 preferably has a length of about 5.6 to six (6) inches (15.24 cm) and a width or diameter of about 1.25 inches. Preferably, the free end 16 of the stem spaced from the bottom of the post is curved or rounded to facilitate installation of the post. In other embodiments, the stem has a length of between about 3 and 9 inches and preferably between about 4 and 7.5 inches.

An anchor member 20 includes a top plate 24 and an elongated receptacle 22 attached to the top plate (e.g., by welding). The receptacle extends from the top plate in a longitudinal direction along axis 18. Preferably, the anchor, including the receptacle, is made of hot-dipped galvanized steel. The receptacle preferably has an outer diameter of about 1.50 inches and a wall thickness of about 0.109 inches, resulting in an inner diameter of about 1.282 inches. As such, the outer diameter of the stem, which is less than the inner diameter of the receptacle, is about 97.5% of the inner diameter of the receptacle. In another embodiment, the outer diameter of the stem is at least about 80% of the inner diameter of the receptacle, more preferably at least about 90% of the inner diameter of the receptacle, and most preferably at least about 95% of the inner diameter. In one embodiment, the outer diameter of the stem is between about 95% and about 99% of the inner diameter of the receptacle. In addition, the longer the stem, the lower the ratio of the outer diameter of the stem to the inner diameter of the receptacle required to maintain the connection of the stem in the receptacle.

Preferably, the receptacle 22 has a cavity 26 with a depth at least equal to or greater than the length of the stem 12. In one embodiment, the receptacle has a depth of about 7.8 to 8 inches. (20.32 cm). The plate 24 is preferably square, with chamfered corners 28, and has a width of about 4.5 inches, which is greater than the width of the post. Of course, it should be understood that the plate can be formed in any shape, including for example and without limitation as a circle, hexagon, pentagon, octagon, rectangle, oval, etc. When installed, in one embodiment, the bottom 8 of the post rests or is supported on the top of the plate 24.

To install the anchor, a 1 and ¾ inch diameter by 8 and ¼ inch deep hole 32 is drilled in a pathway 30. The term "pathway" means any surface traveled upon by a user, including without limitation vehicles, pedestrians, bicycles, etc. Exemplary pathways include without limitation, roadways, sidewalks, parking surfaces, walking/biking paths, arenas/concert venues, etc. The hole 32 is blown out, preferably with compressed air, to remove all debris. Preferably, a clean, dry surface is provided on the pathway in the hole and around the periphery thereof, preferably for at least a four-inch diameter. An epoxy, for example ((part No. SHEPX-13-KI) 5 oz Part "A" and 5 oz Part "B" of 1101 concressive epoxy available from Safe-Hit® company), is mixed and applied generously to the outside diameter of the anchor receptacle 22 and the bottom of the plate 24. The anchor 20, and in particular the receptacle, is inserted into the hole and the plate 24 is pressed down firmly until a bead of epoxy appears around the edge of the plate. The epoxy should be allowed to cure before installing the delineator post.

After the anchor 20 is securely installed in the pathway 30, the post can be easily and simply installed merely by inserting the stem 12 in the receptacle 22. The rounded nose 16 of the stem facilitates that installation. Once aligned, the delineator 2 can simply be dropped, such that the stem 12 is received in the receptacle 22 and the bottom 8 of the post rests on top of the plate member 24, with the post then being in a normal, at-rest position. Alternatively, the plate member can be omitted, or made smaller in size, with the bottom of the post resting or being supported directly on the pathway. In yet another alternative embodiment (not shown), the stem bottoms out in the receptacle with the bottom of the post member being maintained above the plate member and/or pathway.

It should be understood that the term "anchor" can refer to and include a portion of the pathway itself having a hole drilled therein without a separate member(s) being installed therein, a combination of the pathway and a separate member installed therein, or a separate member(s) alone without the pathway. In the first embodiment (not shown), installing the anchor in a pathway simply refers to forming a hole in the pathway, with the hole defining the receptacle and with the surface of the pathway defining a top of the anchor. In another embodiment, the anchor includes a separate receptacle installed in a hole in the ground without a top plate, with the "top" of the anchor being defined as the surface of the pathway, an upper portion of the receptacle, or a combination thereof.

Once installed, the delineator 2 can be removed simply by grasping the post 4 and pulling it in a longitudinal direction along axis 18 such that the stem 12 is completely removed from the receptacle 22, with the post and stem then being in a non-deployed position. The stem/receptacle interface maintains the post in the ground or pathway without any other retention mechanism, such as mechanical fasteners, adhesives, detents, snaps, tabs, etc.

When the post 4 is in the normal, at-rest position, a portion of the length of the stem 12, which in one embodiment is virtually the entirety of the stem, is disposed in the receptacle 22 at a first position. When the post 4 is removed to the non-deployed position, the stem 12 is entirely removed from the receptacle 22.

Figure 5:
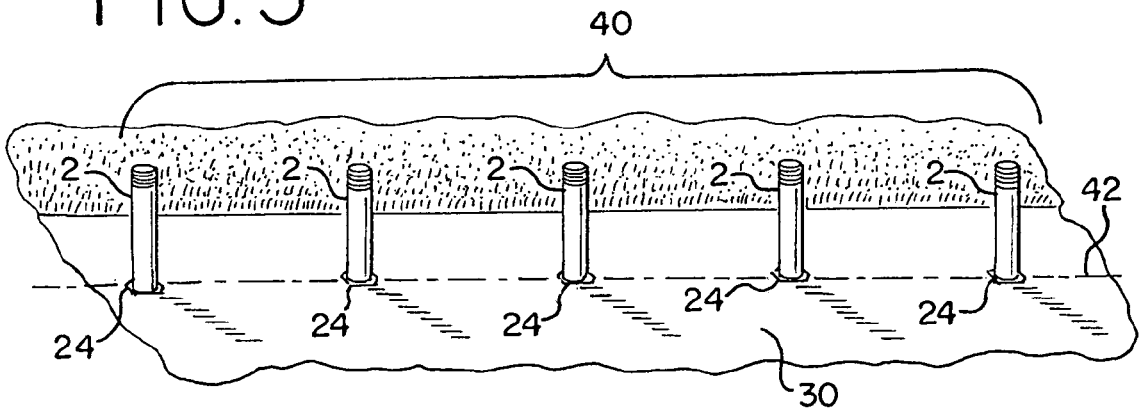
FIG. 5 is a side view of a delineator system making a boundary in a pathway.

When the delineator 2, or a plurality (meaning two or more) of delineators, is installed on a pathway 30, as shown in FIG. 5, the delineator or system/array 40 of delineators, creates a boundary. The delineators 2, and in particular the posts 4, are flexible and resilient such that they deflect or deform upon impact and then return to their original shape and/or configuration. Accordingly, the delineators provide a visual and physical barrier, but do not cause damage if they are inadvertently struck, for example by an errant vehicle. At the same time, the delineators can be easily installed, for example by dropping them into the receptacle from a passing vehicle, without having to engage or bypass a retention mechanism.

Figure 6:
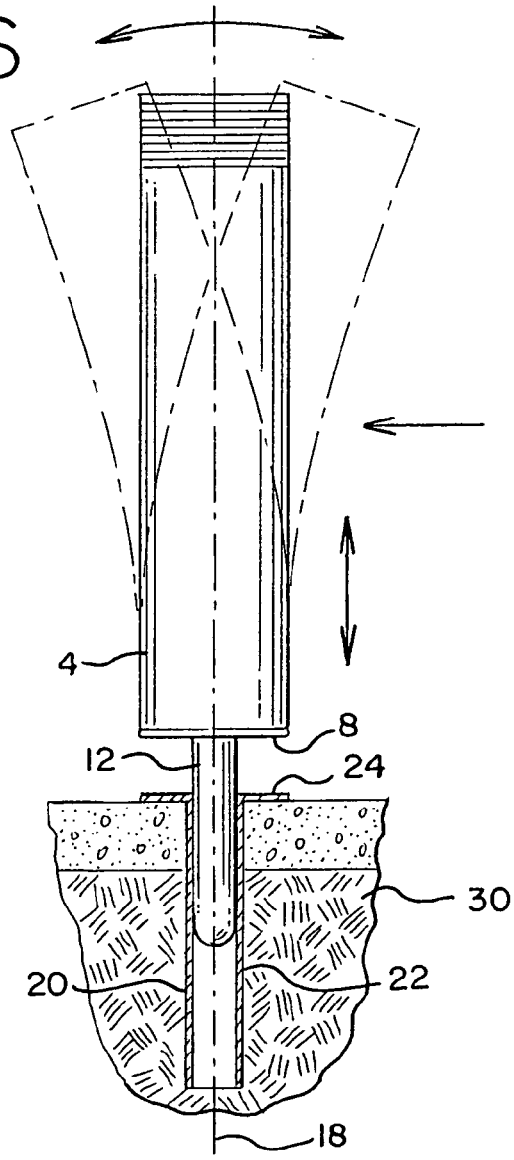
FIG. 6 is a side view of a delineator after the delineator has been impacted by a vehicle.

The configuration and interface of the stem 12 and receptacle 22 also allow the delineator 2 to remain upright and engaged with the anchor 20 after the impact. In particular, upon an impact to the delineator 2, for example an impact from the bumper of a vehicle passing over the delineator, the post 4 moves, e.g., bends, deflects and/or rotates, in a lateral direction to an impact position. As the post 4 is moved to the impact position, the stem 12 is partially withdrawn from the receptacle 22, for example one to three inches, as the stem moves from the first at-rest position to a second impact position such that a lesser length or portion of the stem is disposed in the receptacle when the stem is in the impact position. It should be understood that the "impact" position of the stem is the highest position (greatest withdrawal) of the stem relative to the receptacle caused by the impact, whether that occurs immediately upon impact by the vehicle or after the post is disengaged from the vehicle. As the stem 12 is moved to the impact position, the bottom 8 of the post also is lifted off of the top of the plate 24 of the anchor 20 in a spaced apart relationship. In the preferred embodiment, at least a portion of the stem 12 is maintained within the receptacle 22 during and after the impact. Referring to FIG. 6, after the vehicle, or other impacting object, has passed over the delineator, the post 4 returns to its original shape and/or configuration and the delineator 2 rocks back and forth as the stem 12 self-inserts and settles back into the receptacle 22 and the bottom 8 of the post 4 engages the top of the plate 24 and is re-supported thereby without human intervention (i.e., in response to the pull of gravity) until the stem 12 and post 4 are in the first, at-rest position.

Various tests were run to evaluate the ability of the delineator 2 to retain connection with the anchor 20 and to reinsert itself without human intervention when impacted by a vehicle. In a first test, five posts, as shown in FIGS. 1–5, were impacted at 45+/−2 mph with a vehicle bumper 250 times. The impact vehicle was a 1990 Ford Festiva having a 1900 lb curb weight. The delineators were KonaPost™ delineators having a 5.6 inch long by 1.25 inch outer diameter stem with a rounded nose inserted into an anchor having an 8 inch depth and a 1.28 inch inner diameter. As such, the outer diameter of the stem was approximately 97.5% of the inner diameter of the receptacle.

The five posts were impacted successively by the bumper of a vehicle near the headlight, with the vehicle traveling at 45+/−2 mph in the direction of the line/boundary 42 defined by the array 40 of posts. Each post was impacted 250 times, with the ambient temperature of the tests being initiated at 79 degrees F. (92 impacts), 93 degrees F. (33 impacts) and 81 degrees F. (125 impacts). The delineators were retained in the anchors for 97.7% of the 250 impacts, with the stems 12 being lifted from the at-rest position to an impact position, and then self-inserting and settling to the at-rest position 93.5% of the time. Accordingly, the delineators were retained at least 95% of the time, and reinserted to the at-rest position at least 90% of the time. Based on this information, it is believed that the delineators would likewise be retained in their anchors when impacted by a vehicle traveling at 30 mph.

In contrast, in three separate tests, a KonaPost™ delineator having a 5.6 inch long by 1.25 inch outer diameter stem with a rounded nose inserted into an anchor having an 8 inch depth and a 1.61 inch inner diameter was completely disengaged and removed from the anchor when impacted by a vehicle (1991 Ford Taurus) traveling at 30 mph, 45 mph and 60 mph, with the post coming out of the receptacle on the first hit. In this embodiment, the outer diameter of the stem was approximately 78% of the inner diameter of the receptacle.

In a second test, the five posts, as shown in FIGS. 1–5, were impacted in a wheel-over condition 225 times using a 1990 Ford Festiva having a 1900 lb curb weight and traveling at 45 mph. The delineators were KonaPost™ delineators having a 5.6 inch long by 1.25 inch outer diameter stem with a rounded nose inserted into an anchor having an 8 inch depth and a 1.28 inch inner diameter. As such, the outer diameter of the stem was approximately 97.5% of the inner diameter of the receptacle.

The five posts were impacted successively in the wheel-over test in the direction of the line/boundary 42 defined by the array 40 of posts. Each post was impacted 234 times, with the ambient temperature of the tests being initiated at 81 degrees F. (100 impacts) and 50 degrees F. (134 impacts). The delineators were retained in the anchors for 97.8% of the 234 impacts, with the stems 12 being lifted from the at-rest position to an impact position, and then self-inserting and settling to the at-rest position 92.5% of the time. Accordingly, the delineators were retained at least 95% of the time, and reinserted to the at-rest position at least 90% of the time.

In contrast, in two separate tests, a KonaPost™ delineator having a 5.6 inch long by 1.25 inch outer diameter stem with a rounded nose inserted into an anchor having an 8 inch depth and a 1.61 inch inner diameter was completely disengaged and removed from the anchor when impacted in a wheel-over test by a vehicle (1991 Ford Taurus) traveling at 35 mph and 45 mph, with the post coming out of the receptacle on the second and first hits respectively. In this embodiment, the outer diameter of the stem was approximately 78% of the inner diameter of the receptacle.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A delineator comprising:

a post comprising a bottom portion and a stem extending longitudinally from said bottom portion along a longitudinal axis, wherein at least a portion of said post is flexible, and wherein said post and said stem are integrally formed as a single unitary component from the same flexible material; and an anchor comprising a top and an elongated, longitudinally extending receptacle, wherein said stem is removably inserted in said receptacle;

wherein at least a portion of said post is moveable in a lateral direction between an at-rest position and an impact position in response to an impact from a vehicle traveling at 45 mph, and wherein said stem is moveable in a longitudinal direction between at least a first position and a second position relative to said receptacle as said post is moved between said at-rest position and said impact position respectively, wherein a first portion of said length of said stem is disposed in said receptacle when said stem is in said first position and wherein a second portion of said length of said stem remains disposed in said receptacle when said stem is in said second position, wherein said first portion is greater than said second portion, and wherein said post is moveable in said longitudinal direction between said at-rest position and a non-deployed position, wherein said stem is moveable in said longitudinal direction between said first position and a third position relative to said receptacle as said post is moved between said at-rest position and said non-deployed position respectively, wherein an entirety of said length of said stem is removed from said receptacle when said stem is in said third position, and wherein said stem is freely moveable relative to said receptacle between said first and third positions free of any retention mechanism that would increase the force required to move the stem relative to the receptacle between said first and third positions, and wherein said post is freely rotatable about said longitudinal axis relative to said receptacle as said stem is moved between said first and third positions.

2. The delineator of claim 1 wherein said receptacle has a depth at least as great as said length of said stem.

3. The delineator of claim 1 wherein said bottom portion is supported on said top of said anchor when said flexible post is in said at-rest position, and wherein said bottom portion is spaced above said top of said anchor when said post is in said impact position.

4. The delineator of claim 3 wherein outer surfaces of each of said post and said stem define first and second cross-sectional areas respectively, wherein said first cross-sectional area of said post is greater than said second cross-sectional area of said stem.

5. The delineator of claim 4 wherein said first and second cross-sectional areas comprise first and second circles, having first and second diameters respectively, defined by said outer surfaces of said post and said stem, wherein said first diameter of said post is greater than said second diameter of said stem.

6. The delineator of claim 1 wherein said stem has a length of between about three and nine inches.

7. The delineator of claim 1 wherein said stem has an outer diameter that is at least about 95% of an inner diameter of said receptacle.

8. A delineator comprising:

a post comprising a bottom portion and a stem extending longitudinally from said bottom portion along a longitudinal axis, wherein at least a portion of said post is flexible, and wherein said post and said stem are integrally formed as a single unitary component from the same flexible material; and an anchor comprising a top and an elongated, longitudinally extending receptacle, wherein said stem is removably inserted in said receptacle, wherein said stem is freely moveable relative to said receptacle in said longitudinal direction free of any retention mechanism that would increase the force required to move the stem relative to the receptacle in said longitudinal direction, and wherein said post is freely rotatable about said longitudinal axis relative to said receptacle as said stem is moved between said first and third positions;

wherein at least a portion of said post is moveable in a lateral direction between an at-rest position and an impact position in response to an impact from a bumper of a vehicle traveling at least 30 mph, and wherein at least a portion of said stem is retained in said receptacle as said post is moved between said at-rest position and said impact position.

9. The delineator of claim 8 wherein said post is moveable in said lateral direction between said at-rest position and said impact position in response to an impact from a bumper of a vehicle traveling 45 mph.

10. The delineator of claim 8 wherein said post is moveable in said longitudinal direction between said at-rest position and a non-deployed position, wherein said stem is moveable in said longitudinal direction between a first position and a second position relative to said receptacle as said post is moved between said at-rest position and said non-deployed position respectively, wherein an entirety of said stem is removed from said receptacle when said stem is in said second position.

11. The delineator of claim 8 wherein said receptacle has a depth at least as great as said length of said stem.

12. The delineator of claim 7 wherein said outer diameter is at least about 97% of said inner diameter.

13. The delineator of claim 7 wherein said outer diameter is between about 95% and about 99% of said inner diameter.

14. The delineator of claim 8 wherein said stem has an outer diameter and a length, wherein at least a portion of said post is moveable in a lateral direction between an at-rest position and an impact position; and wherein said anchor has an inner diameter, wherein said inner diameter is greater than said outer diameter and wherein said outer diameter is at least about 95% of said inner diameter.

15. The delineator of claim 14 wherein said stem is moveable in said longitudinal direction between at least a first position and a second position relative to said receptacle as said post is moved between said at-rest position and said impact position respectively, wherein a first portion of said length of said stem is disposed in said receptacle when said stem is in said first position and wherein a second portion of said length of said stem remains disposed in said receptacle when said stem is in said second position, wherein said first portion is greater than said second portion.

16. The delineator of claim 14 wherein said outer diameter is at least about 97% of said inner diameter.

17. The delineator of claim 14 wherein said outer diameter is between about 95% and about 99% of said inner diameter.

18. The delineator of claim 8 wherein said bottom portion is supported on said top of said anchor when said flexible post is in said at-rest position, and wherein said bottom portion is spaced above said top of said anchor when said post is in said impact position.

19. The delineator of claim 18 wherein outer surfaces of each of said post and said stem define first and second cross-sectional areas respectively, wherein said first cross-sectional area of said post is greater than said second cross-sectional area of said stem.

20. The delineator of claim 19 wherein said first and second cross-sectional areas comprise first and second circles, having first and second diameters respectively, defined by said outer surfaces of said post and said stem, wherein said first diameter of said post is greater than said second diameter of said stem.

* * * * *

UNITED STATES PATENT AND TRADEMARK OFFICE

CERTIFICATE OF CORRECTION

PATENT NO. : 7,249,910 B2
APPLICATION NO. : 10/841972
DATED : July 31, 2007
INVENTOR(S) : Eckert et al.

It is certified that error appears in the above-identified patent and that said Letters Patent is hereby corrected as shown below:

Item 54 and Col. 1, 1-2 on Title Page

The Title should read:

--SEMICONDUCTOR DEVICE AND IT'S MANUFACTURING METHOD--

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,249,910 B2
APPLICATION NO. : 10/841972
DATED : July 31, 2007
INVENTOR(S) : Bret R. Eckert et al.

It is certified that error appears in the above-identified patent and that said Letters Patent is hereby corrected as shown below:

On the Title Page

Column 1, item (54), the title should read:

--REMOVABLE DELINEATOR POST AND METHOD FOR THE USE THEREOF--.

In the Specification

Column 1, the title should read:

--REMOVABLE DELINEATOR POST AND METHOD FOR THE USE THEREOF--.

Signed and Sealed this

Twenty Second Day of April, 2008

JON W. DUDAS
*Director of the United States Patent and Trademark Office*